US007862306B2

(12) United States Patent
Staley et al.

(10) Patent No.: US 7,862,306 B2
(45) Date of Patent: Jan. 4, 2011

(54) PRESSURE REGULATING VARIABLE DISPLACEMENT VANE PUMP

(75) Inventors: David R. Staley, Flushing, MI (US); Bryan K. Pryor, Farmington, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 1003 days.

(21) Appl. No.: 11/671,868

(22) Filed: Feb. 6, 2007

(65) Prior Publication Data

US 2008/0187446 A1 Aug. 7, 2008

(51) Int. Cl.
*F04B 49/00* (2006.01)

(52) U.S. Cl. ..... 417/220; 417/219; 418/26; 418/27; 418/30

(58) Field of Classification Search ..... 417/219, 417/220, 221; 418/26–27, 30–31; 123/196 R
See application file for complete search history.

(56) References Cited

U.S. PATENT DOCUMENTS 3,743,445 A * 7/1973 Dworak et al. ..... 417/220
4,437,819 A * 3/1984 Merz ..... 418/26
5,752,815 A * 5/1998 Muller ..... 418/26
6,763,797 B1 * 7/2004 Staley et al. ..... 123/196 R
7,614,858 B2 * 11/2009 Tanasuca ..... 418/26
2003/0059313 A1 * 3/2003 Hanggi ..... 417/220
2005/0019174 A1 * 1/2005 Uchino et al. ..... 417/410.3
2007/0224067 A1 * 9/2007 Arnold et al. ..... 418/26

* cited by examiner

*Primary Examiner*—Charles G Freay
*Assistant Examiner*—Todd D Jacobs

(57) ABSTRACT

A variable displacement engine oil vane pump includes a displacement control for controlling displacement of the pump. The control includes a cam ring in a housing pivotally connected to a wall of the housing by a pivot. The cam ring is internally engaged by slide vanes. A control chamber is defined by the cam ring and the housing wall. A control orifice provides for communication of control oil from a pressurized source to the control chamber. A vent chamber is generally opposite the control chamber and is defined by the cam ring and the housing wall. A dump chamber is defined by the cam ring and the housing wall and is generally disposed between the control chamber and the vent chamber. A dump orifice provides for communication between the control chamber and the dump chamber. A vent orifice provides for communication between the vent chamber and the dump chamber.

20 Claims, 5 Drawing Sheets

PRESSURE REGULATING VARIABLE DISPLACEMENT VANE PUMP

TECHNICAL FIELD

This invention relates to engine lubrication systems and, more particularly, to variable displacement pumps for supplying engine oil to internal combustion engines.

BACKGROUND OF THE INVENTION

It is known in the art relating to internal combustion engines that modern vehicle engine designs utilize engine oil pressure to enable various forms of variable engine valve actuation devices, including cam phasers and cylinder deactivation devices. Such variable valve actuation devices have strict pressure requirements. For example, cam phasers require a certain minimum pressure for proper function, while an excess pressure condition can cause cylinder deactivation system malfunction. Due to the strict pressure requirements of these devices, use of these devices has created a very narrow operational pressure window for the lubrication system of the engine.

Previously, in U.S. Pat. No. 6,763,797, we disclosed a variable displacement pump in which pump outlet pressure is used to bias the position of a cam ring (slide), thereby changing the eccentricity of the pump and consequently varying the pump displacement. By varying the pump displacement relative to pump outlet pressure, the pump outlet pressure can be controlled based on engine flow requirements. The pressure regulation characteristics of the pump are determined by calibrating a reaction spring that counterbalances the hydraulic forces acting on the cam ring. Further optimization of the pressure regulation characteristics of variable displacement pumps used in engine lubrication systems is desirable.

SUMMARY OF THE INVENTION

The present invention provides a variable displacement vane pump that utilizes a pressure source from the engine (for example, the outlet pressure of the pump or a feedback pressure from the engine) to regulate the displacement of the pump. The variable displacement vane pump may be used with an internal combustion engine and includes a control chamber, a dump chamber, and a vent chamber that are cooperable to vary the displacement of the pump depending upon the operating conditions of the engine. Such operating conditions include normal engine operation, high engine speed operation, and cold engine operation. By selectively varying its displacement, the pump ensures that the oil pressure in the engine lubrication system is maintained within the narrow range of operating pressures necessary for proper functioning of the engine components.

In an exemplary embodiment, a variable displacement vane oil pump in accordance with the invention includes pumping chambers defined by slide vanes carried by a rotor rotatable in a housing for pumping engine oil from an inlet to a pressurized outlet. The vane pump also has a displacement control for controlling displacement of the pumping chambers. The displacement control includes a cam ring in the housing pivotally connected to a wall of the housing by a pivot. The cam ring is internally engaged by the vanes. A control chamber is generally defined by the cam ring and the housing wall. A control orifice provides for communication of control oil from the pressurized outlet to the control chamber. Control oil in the control chamber exerts a force on the cam ring. A resilient member biases the cam ring in a direction opposite to a direction of the force exerted by the control oil in the control chamber.

A vent chamber is disposed generally opposite the control chamber and is defined by the cam ring and the housing wall. The vent chamber is at approximately atmospheric pressure. A dump chamber is defined by the cam ring and the housing wall and is generally disposed between the control chamber and the vent chamber. A dump orifice provides for communication of fluid between the control chamber and the dump chamber. Control oil in the dump chamber is capable of exerting a force on the cam ring that, in combination with the force of control oil in the control chamber, opposes the biasing force of the resilient member. A vent orifice provides for communication of fluid between the vent chamber and the dump chamber in order to vent the dump chamber.

The cam ring is pivotable in the housing to positions at which the dump orifice and vent orifice are open or closed. In one position of the cam ring, the dump orifice and vent orifice are open. In another position of the cam ring, the dump orifice is open while the vent orifice is closed. In yet another position of the cam ring, the dump orifice is closed while the vent orifice is open. Further, the pivotal motion of the cam ring may vary the size of the control orifice, dump orifice, vent orifice, or any combination of the three orifices, and therefore the amount of flow of control oil through the flow orifices from the pressurized outlet to the control chamber.

These and other features and advantages of the invention will be more fully understood from the following description of certain specific embodiments of the invention taken together with the accompanying drawings.

DESCRIPTION OF AN EXEMPLARY EMBODIMENT

Figure 1:
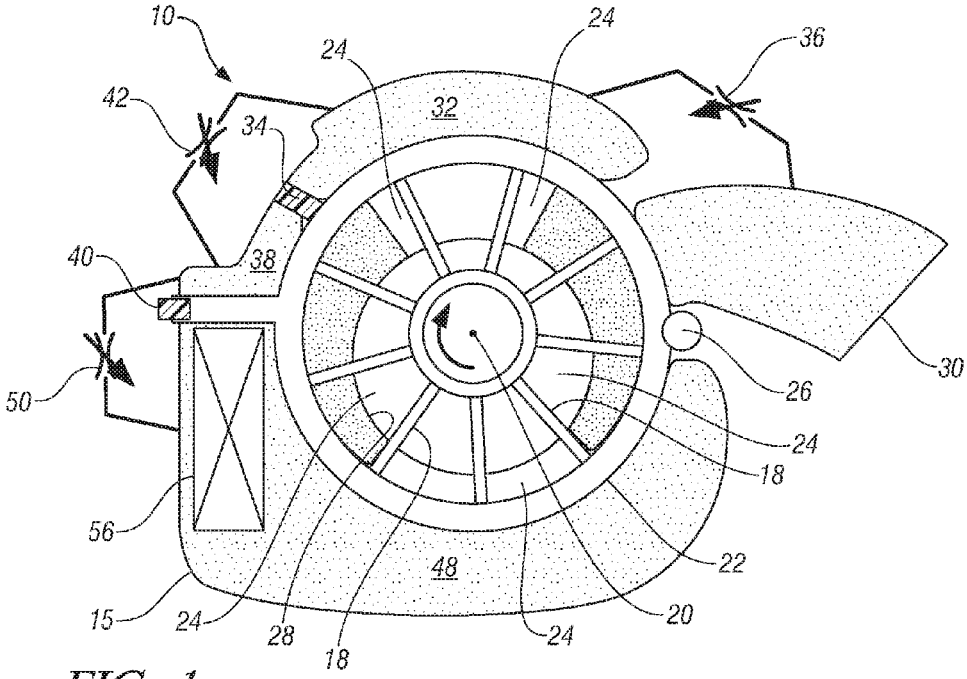
FIG. 1 is a schematic view of a variable displacement vane pump in accordance with the invention.

Referring now to the drawings in detail, numeral 10 generally indicates a variable displacement vane pump in accordance with the invention for use in a lubrication system of an internal combustion engine. As is more fully hereinafter described, the variable displacement vane pump 10 provides for improved regulation of pump outlet flow pressure within a narrow range of pressures during various engine operating conditions.

Figure 2:
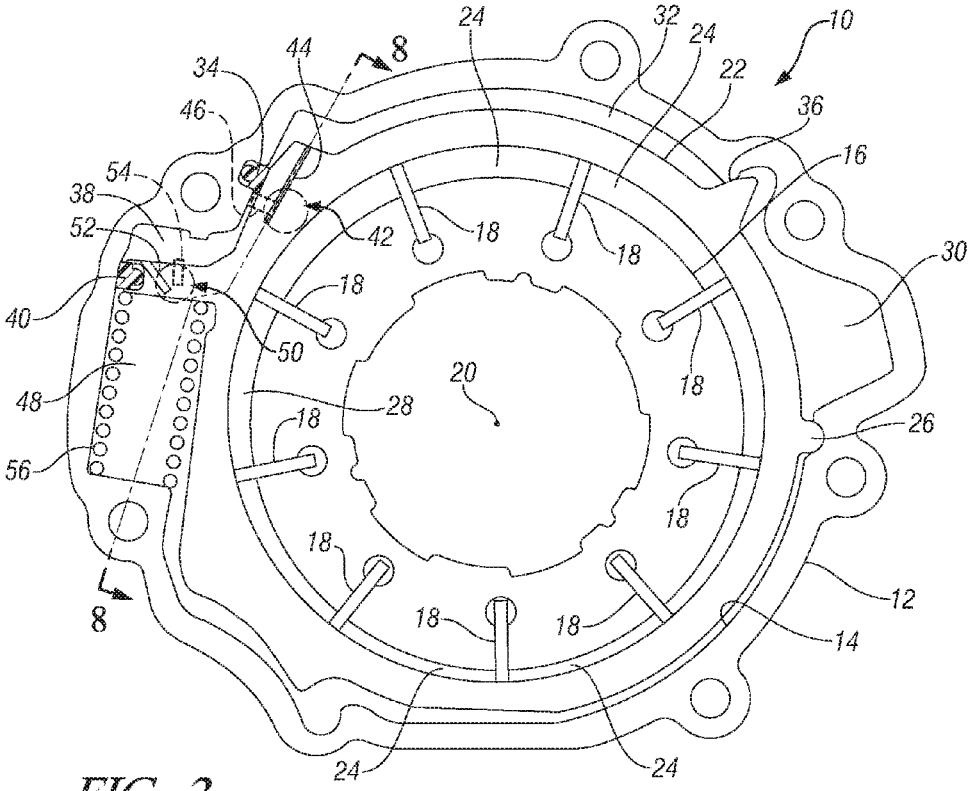
FIG. 2 is a plan view of a variable displacement vane pump of the invention with a housing cover removed to show internal elements of the pump in a low displacement position of the cam ring.

As illustrated in FIGS. 1 and 2, the variable displacement vane pump 10 for use with an internal combustion engine includes a housing 12 having a peripheral wall 14 and a cover 15 (shown schematically in FIG. 1). The outside of the housing 12 may be mounted to an engine body by a fastener such as a mounting bolt. A rotor 16 having a plurality of slide vanes 18 is rotatable in the housing 12 on a fixed axis 20. The rotor 16 may be driven by a cross-axis hex shaft drive of the engine or other suitable driving means powered by the engine. The slide vanes 18 internally engage a cam ring 22 to define pumping chambers 24 within the cam ring 22.

The cam ring 22 is pivotally connected to the housing wall 14 by a pivot 26 and is pivotable to vary the displacement of the pumping chambers 24. The displacement of the pump is proportional to the eccentricity of the cam ring 22 relative to the axis 20 of the rotor 16. When the pump is at rest, the cam ring 22 is urged into a position of maximum eccentricity relative to the rotor 16. When the pump operates with the cam ring 22 in this position, the displacement of the pump is at its maximum value. As the cam ring 22 pivots away from a position of maximum eccentricity, the displacement of the pump is reduced and the output flow of the pump generally decreases. When the center of the cam ring 22 is pivoted to a position at which it is aligned with the axis 20 of the rotor 16, the cam ring 22 is at 0% eccentricity (i.e., 100% from its maximum eccentricity) and the pump 10 operates at zero displacement.

An oil inlet port 28 is formed on an inlet side of the housing 12 and a pressurized oil outlet port 30 is formed on an opposite outlet side of the housing. The inlet and outlet ports 28, 30 preferably communicate with the pumping chambers 24 on opposite bottom and top sides of the rotor 16 in order to prevent entrapment of gases in the pumping chambers 24. Rotation of the rotor 16 at some level of eccentricity causes the pumping chambers 24 to expand. This change in chamber volume in turn causes a decompression of the pumping chambers which causes oil to be sucked into the pumping chambers 24 through the inlet port 28 and then pushed out of the pumping chambers 24 through the outlet port 30 as the chambers contract.

A control chamber 32 is defined internally by the housing wall 14, the cam ring 22, and a first seal 34 disposed between the housing wall 14 and the cam ring 22. A control orifice 36 is disposed between the control chamber 32 and the pressurized oil outlet 30 for communicating engine lubricating oil (i.e., control oil) from the outlet port 30 to the control chamber 32. Alternatively, an oil signal pressure from elsewhere in the engine may be fed back to the control orifice 36. In any event, the control oil pressure in the control chamber 32 varies with the oil pressure in the oil lubrication system of the engine. Control oil pressure in the control chamber 32 exerts a force on the cam ring 22 capable of causing the cam ring to pivot about the pivot 26. The pivotal motion of the cam ring 22 may vary the size of the control orifice 36, thereby varying the amount of flow of control oil through the flow orifice from the pressurized outlet to the control chamber. Varying the size of the control orifice 36 therefore varies the response of the pump system.

Figure 3:
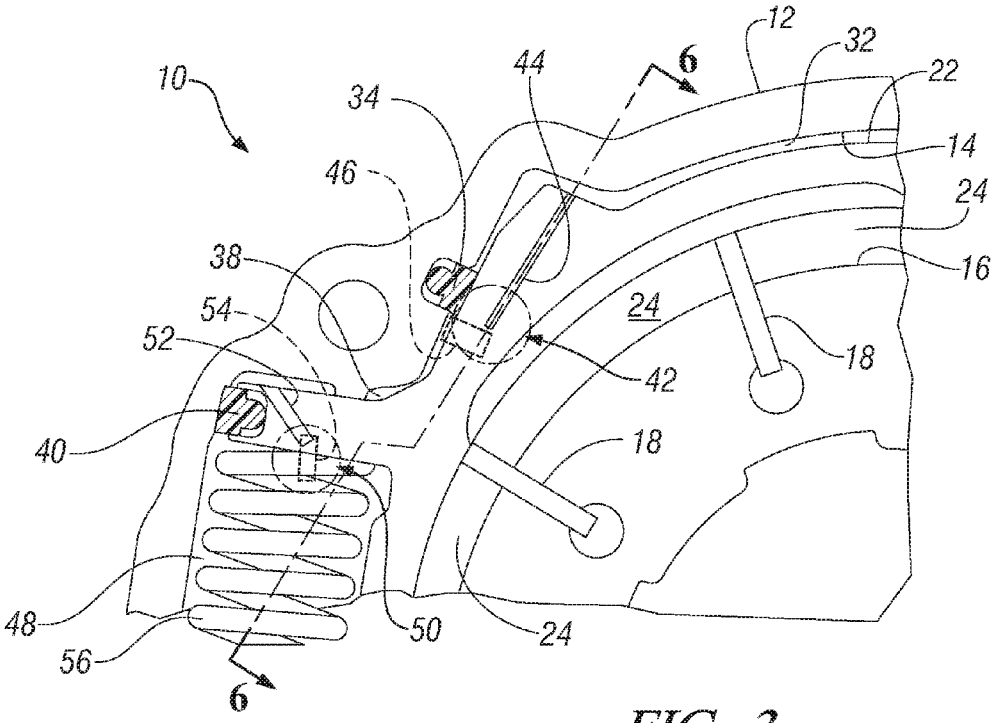
FIG. 3 is an enlarged view of a portion of the pump of FIG. 2 illustrating a dump orifice of the pump in a closed position, a vent orifice of the pump in an open position, and the cam ring in a high displacement position.
Figure 4:
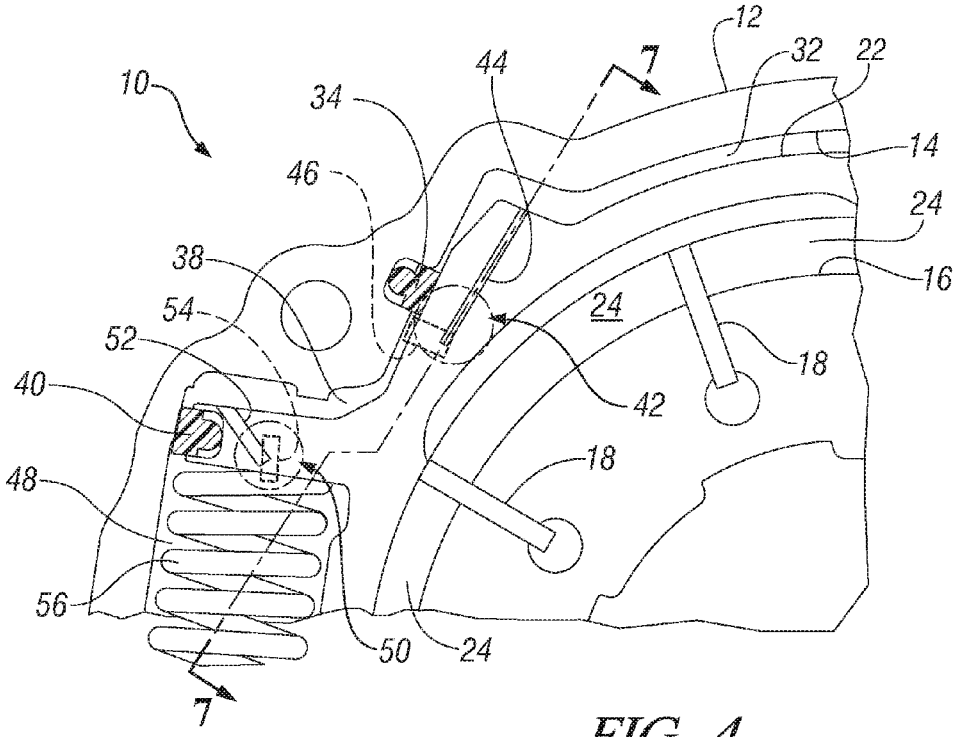
FIG. 4 is a view similar to FIG. 3 but illustrating the dump orifice and the vent orifice in open positions and the cam ring in an intermediate displacement position.
Figure 5:
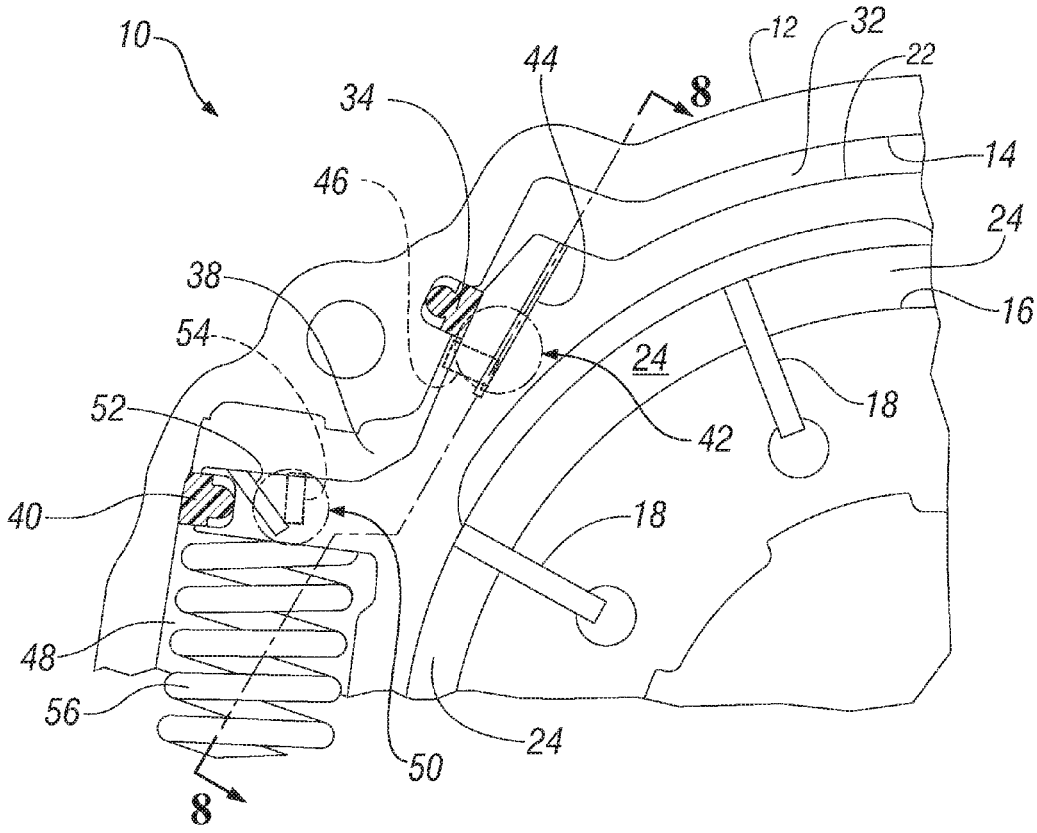
FIG. 5 is a view similar to FIG. 3 but illustrating the dump orifice in the open position, the vent orifice in the closed position, and the cam ring in a low displacement position as in FIG. 2.

Referring also to FIGS. 3-5, dump chamber 38 is disposed adjacent the control chamber 32 and is defined by the housing wall 14, the cam ring 22, the first seal 34 and a second seal 40. A dump orifice 42 provides for communication of control oil between the control chamber 32 and the dump chamber 38 and is defined by an intersection of a first groove 44 in the cam ring 22 and a first groove 46 in the housing cover. Control oil in the dump chamber 38 is capable of exerting a force on the cam ring 22 that works in combination with the force exerted by control oil in the control chamber 32 to pivot the cam ring 22 about the pivot 26.

A vent chamber 48 is disposed adjacent the dump chamber 38 and is defined by the housing wall 14, the cam ring 22, and the second seal 40. The vent chamber 48 is generally kept at or near atmospheric pressure. A vent orifice 50 connects the dump chamber 38 with the vent chamber 48 for venting the dump chamber 38 and is defined by an intersection of a second groove 52 in the cam ring 22 and a second groove 54 in the housing cover.

The first grooves 44, 46 and second grooves 52, 54 are arranged such that pivotal movement of the cam ring 22 in the housing 12 varies the position of the first grooves relative to each other as well as the position of the second grooves relative to each other. When the first cam ring groove 44 and first housing cover groove 46 are in alignment, the dump orifice 42 is open and fluid may flow between the control chamber 32 and the dump chamber 38. As the cam ring 22 pivots away from this position, the first grooves 44, 46 move out of alignment and the dump orifice 42 closes. Similarly, when the second cam ring groove 52 and second housing cover groove 54 are in alignment, the vent orifice 50 is open and dump chamber 38 is in fluid communication with the vent chamber 48. As the cam ring 22 pivots away from this position, the second grooves 52, 54 move out of alignment and the vent orifice 50 closes.

Alternatively, the grooves 44, 46, 52, 54 may be notches or any other geometry that allows for the flow of fluid. It should be understood that the specific geometry of the grooves, such as the flow area and length of the grooves, may be varied to obtain desired flow characteristics for the orifices 42, 50, which in turn affect the response of the pump system 10. Changing the position of the orifices 42, 50 relative to the seals 34, 40 also may vary the response of the pump system 10.

A resilient member 56, such as a spring. is disposed between the housing wall 14 and the cam ring 22. The resilient member 56 engages the cam ring 22 and urges the cam ring toward the control chamber 32. The resilient member 56 counters the hydraulic force exerted on the cam ring 22 by control oil in the control chamber 32 and the dump chamber 38.

Figure 6:
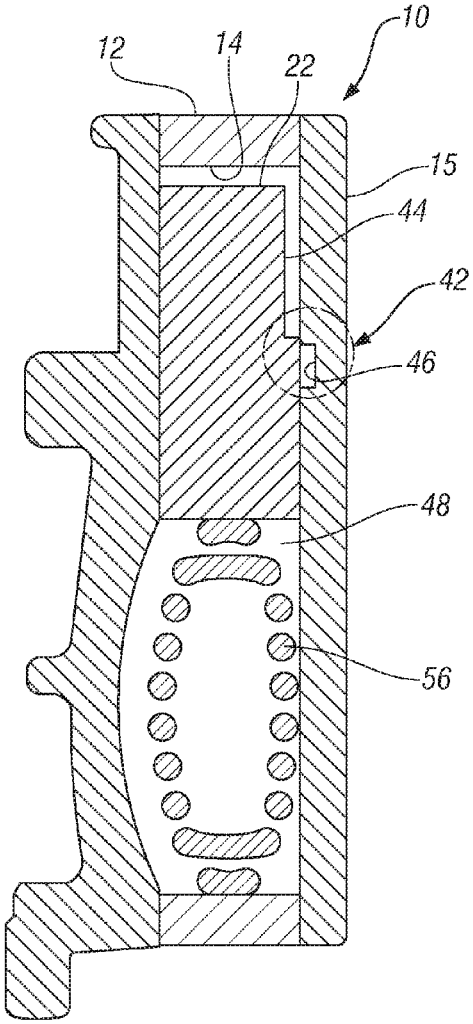
FIG. 6 is a cross-sectional view from the line 6-6 of FIG. 3.

The local pressure in the dump chamber 38 can be biased to atmospheric pressure or control chamber 32 pressure depending on the operational conditions of the engine and the pump 10. With reference to FIGS. 3 and 6, during normal engine operating conditions (i.e., at normal engine operating temperatures and low to moderate engine speeds), the oil pressure in the control chamber 32 is sufficient to urge the cam ring 22 to a position at which the dump orifice 42 is closed and the vent orifice 50 is open. The dump chamber 38 is therefore open to atmospheric pressure through the vent chamber 50. Pressurized control oil is only present in the control chamber 32, and the force of the oil pressure in the control chamber 32 against the cam ring 22 and the opposing force of the resilient member 56 hold the cam ring in a position in which the displacement of the pump is sufficient to maintain the engine oil pressure in a desired range.

Figure 7:
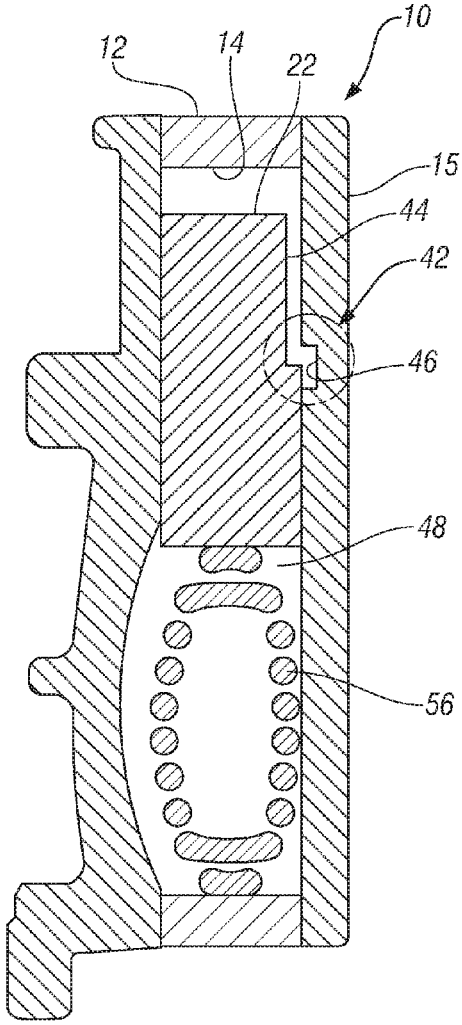
FIG. 7 is a cross-sectional view from the line 7-7 of FIG. 4.

Turning to FIGS. 4 and 7, during high engine speed operation, vane pumps typically experience significant flow loss due to cavitation. To counteract this flow loss, as pump outlet oil pressure decreases, the resulting reduction of pressure in the control chamber 32 causes the cam ring 22 to move to a position at which the dump orifice 42 and the vent orifice 50 are open. In this position, the dump chamber 38 and control chamber 32 are open to atmospheric pressure, and control oil is permitted to leak from the control chamber 32 to the vent chamber 48. As a result, the pressure drop across the control orifice decreases. The pressure decrease in the control chamber 32 causes the resilient member 56, which may be a high rate reaction spring, to hold the cam ring 22 in a position at which the pump eccentricity is relatively high. In turn, the pump displacement is therefore sufficiently high in order to maintain necessary pump outlet pressure. For example, during high speed operation, the cam ring 22 may be pivoted to a position that is approximately 40% to 60% of its maximum eccentricity relative to the rotor 16. In some cases, the position of the cam ring 22 may even be in the range of approximately 30% to 75% of its maximum eccentricity to obtain the necessary pump displacement.

Figure 8:
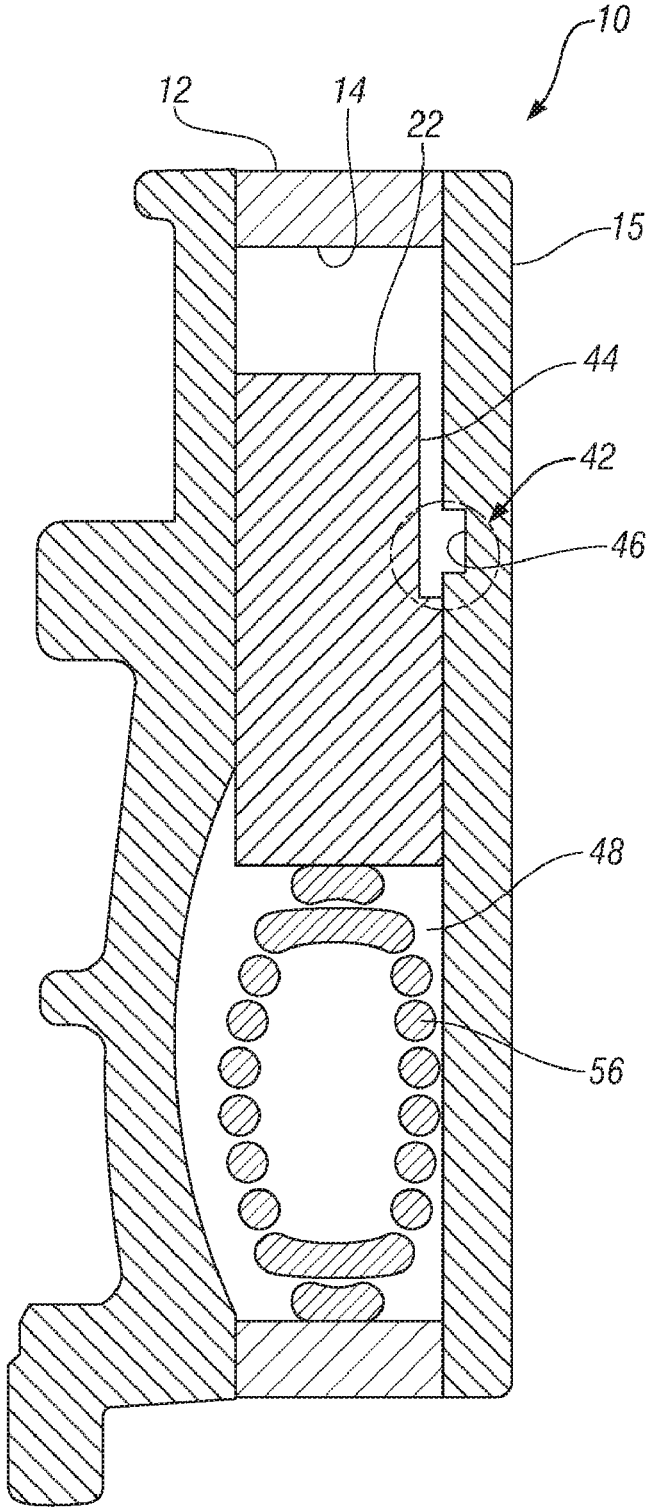
FIG. 8 is a cross-sectional view from the line 8-8 of FIGS. 2 and 5.

Turning to FIGS. 5 and 8, during cold engine temperature operation, the vane pump 10 typically experiences an oil over-pressure condition. To counteract the excess engine oil pressure, when an over-pressure condition exists, the cam ring 22 is moved to a position at which the dump orifice 42 opens and the vent orifice 50 closes. Control oil is thereby permitted to enter the dump chamber 38 from the control chamber 32. Since the vent orifice 50 is closed, the dump chamber 38 is not vented. Therefore, the control oil in the control chamber 32 and the dump chamber 38 is sufficient to exert a force on the cam ring 22 that overcomes the spring force and causes the cam ring to pivot such that its center approaches that of the rotor 16 (i.e., 0% eccentricity). For example, during cold engine temperature operation, the cam ring 22 may be pivoted to a position that is approximately 10% to 25% of its maximum eccentricity, and in some cases even to a position that approaches 0% of its maximum eccentricity (i.e., 100% away from its maximum eccentricity). In this position, pump 10 outlet flow is diminished sufficiently to clip the lubricating oil pressure outputted from the pump 10.

It should be understood that the response of the pump system 10 may be altered by varying the volume and working area (i.e., area over which force is exerted by control oil) of the dump chamber 38 with respect to the volume and working area of the control chamber 32. Further, the spring force exerted by the reaction spring 56 may also be varied to change the response of the pump system 10. In doing so, cam ring 22 movement with respect to control pressure signal can be highly variable.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A variable displacement engine oil vane pump comprising:

pumping chambers defined by slide vanes carried by a rotor rotatable in a housing for pumping engine oil from an inlet to a pressurized outlet;

a displacement control for controlling displacement of the pumping chambers, the displacement control including:

a cam ring in the housing pivotally connected to a wall of the housing by a pivot, the cam ring being internally engaged by the vanes;

a control chamber defined by the cam ring and the housing wall;

a control orifice for communicating control oil to the control chamber;

a vent chamber generally opposite the control chamber and defined by the cam ring and the housing wall, the vent chamber being generally at atmospheric pressure;

a dump chamber defined by the cam ring and the housing wall and being generally disposed between the control chamber and the vent chamber;

a dump orifice providing communication between the control chamber and the dump chamber; and a vent orifice providing communication between the vent chamber and the dump chamber;

wherein pivotal movement of the cam ring in the housing opens and closes the dump orifice and vent orifice independent of each other at specific positions of the cam ring relative to the housing.

2. The pump of claim 1, wherein the cam ring is pivotable to a position at which the control orifice, the dump orifice, and the vent orifice are open.

3. The pump of claim 2, wherein at high engine speeds and warm engine oil temperatures the displacement control pivots the cam ring to a position that is approximately 30% to 75% of its maximum eccentricity relative to the rotor.

4. The pump of claim 3, wherein the displacement control pivots the cam ring to a position that is approximately 40% to 60% of its maximum eccentricity relative to the rotor.

5. The pump of claim 1, wherein the cam ring is pivotable to a position at which the control orifice and the dump orifice are open while the vent orifice is closed.

6. The pump of claim 5, wherein at cold engine oil temperatures the displacement control pivots the cam ring to a position that is approximately 0% to 25% of its maximum eccentricity relative to the rotor.

7. The pump of claim 6, wherein the displacement control pivots the cam ring to a position that is approximately 10% to 25% of its maximum eccentricity relative to the rotor.

8. The pump of claim 1, wherein the cam ring is pivotable to a position at which the control orifice and the vent orifice are open while the dump orifice is closed.

9. The pump of claim 1, wherein varying the position of the cam ring in the housing opens and closes the dump orifice and the vent orifice.

10. The pump of claim 1, wherein the area of the control orifice varies with the position of the cam ring in the housing.

11. The pump of claim 1, including a resilient member biasing the cam ring in a direction opposite to a direction of force exerted by the control oil.

12. A variable displacement vane oil pump for an internal combustion engine comprising:

a housing having a peripheral wall, a cover, an oil inlet, and a pressurized oil outlet;

a rotor rotatable in the housing on a fixed axis, the rotor having a plurality of slide vanes internally engaging a cam ring to define pumping chambers;

the cam ring being pivotally connected to the housing wall by a pivot and pivotable to vary the displacement of the pumping chambers;

a control chamber defined internally by the housing wall, the cam ring, and a first seal disposed between the housing wall and the cam ring;

a control orifice disposed between the control chamber and the pressurized oil outlet for communicating engine oil to the control chamber;

a dump chamber adjacent the control chamber and defined by the housing wall, the cam ring, the first seal, and a second seal;

a dump orifice defined by an intersection of a first groove in the cam ring and a first groove in the housing cover for communicating engine oil between the control chamber and the dump chamber;

a vent chamber adjacent the dump chamber and defined by the housing wall, the cam ring, and the second seal, the vent chamber being generally at atmospheric pressure;

a vent orifice defined by an intersection of a second groove in the cam ring and a second groove in the housing cover connecting the dump chamber and the vent chamber for venting the dump chamber;

wherein pivotal movement of the cam ring in the housing varies the position of the first cam ring groove relative to the first housing cover groove and the second cam ring groove relative to the second housing cover groove, causing the dump orifice and the vent orifice to open and close.

13. The pump of claim 12, wherein the cam ring is pivotable to a position at which the control orifice, the dump orifice, and the vent orifice are open.

14. The pump of claim 12, wherein the cam ring is pivotable to a position at which the control orifice and the dump orifice are open while the vent orifice is closed.

15. The pump of claim 12, wherein the cam ring is pivotable to a position at which the control orifice and the vent orifice are open while the dump orifice is closed.

16. The pump of claim 12, including a resilient member biasing the cam ring.

17. The pump of claim 12, wherein engine oil in the control chamber creates a force against the cam ring capable of causing pivotal movement of the cam ring to alter the displacement of the pump.

18. The pump of claim 12, wherein engine oil is communicated to the dump chamber such that engine oil in the control chamber and dump chamber creates a force against the cam ring capable of causing pivotal movement of the cam ring to decrease the displacement of the pump.

19. The pump of claim 12, wherein venting the dump chamber to the vent chamber via the vent orifice opens the dump chamber to atmospheric pressure.

20. The pump of claim 12, wherein venting the dump chamber and control chamber to the vent chamber via the vent orifice and dump orifice relieves pressure in the dump chamber and control chamber causing pivotal movement of the cam ring to increase the displacement of the pump.

* * * * *